US006581538B2

(12) United States Patent
Sorensen

(10) Patent No.: US 6,581,538 B2
(45) Date of Patent: Jun. 24, 2003

(54) INTEGRATED SAFETY ACCESSORY ARRANGEMENT AND COMPONENTS FOR USERS OF PERSONAL WATERCRAFT

(76) Inventor: John D. 'Jack' Sorensen, P.O. Box 20932, Reno, NV (US) 89515

( * ) Notice: Subject to any disclaimer, the term of this patent is extended or adjusted under 35 U.S.C. 154(b) by 0 days.

(21) Appl. No.: 09/852,233

(22) Filed: May 8, 2001

(65) Prior Publication Data

US 2002/0166493 A1 Nov. 14, 2002

(51) Int. Cl.[7] ..... B63B 17/00

(52) U.S. Cl. ..... 114/343; 114/347

(58) Field of Search ..... 114/347, 343

(56) References Cited

U.S. PATENT DOCUMENTS 6,401,648 B1 * 6/2002 Abbenhouse ..... 114/347

* cited by examiner

*Primary Examiner*—Jesus D. Sotelo

(57) ABSTRACT

An integrated safety accessory arrangement and components for users of personal watercraft such as kayaks, canoes, and catamarans. The arrangement is comprised of safety related components providing the following integrated features: alternate personal hydration for paddlers accommodating common beverage containers as well as compartments for contemporary sports reservoirs with hull and hatch cover ports to route and seal the attached drinking tubes for use underway; and mounting and storage for navigation and communication devices such as marine compasses, GPS, VHF and FRS radios, cell phones, and the like. All are accessible while underway; and one-handed kayak skirt-on use of common portable manual pump with in-hull pump storage holder.

19 Claims, 7 Drawing Sheets

Figure 1A:
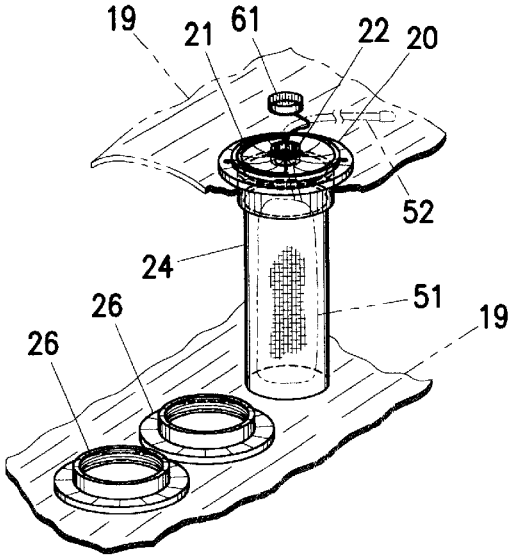

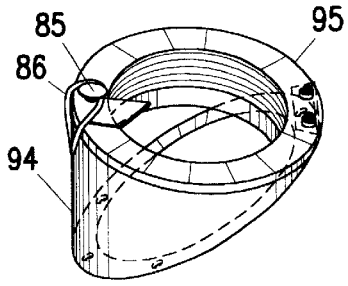
FIG. 9A
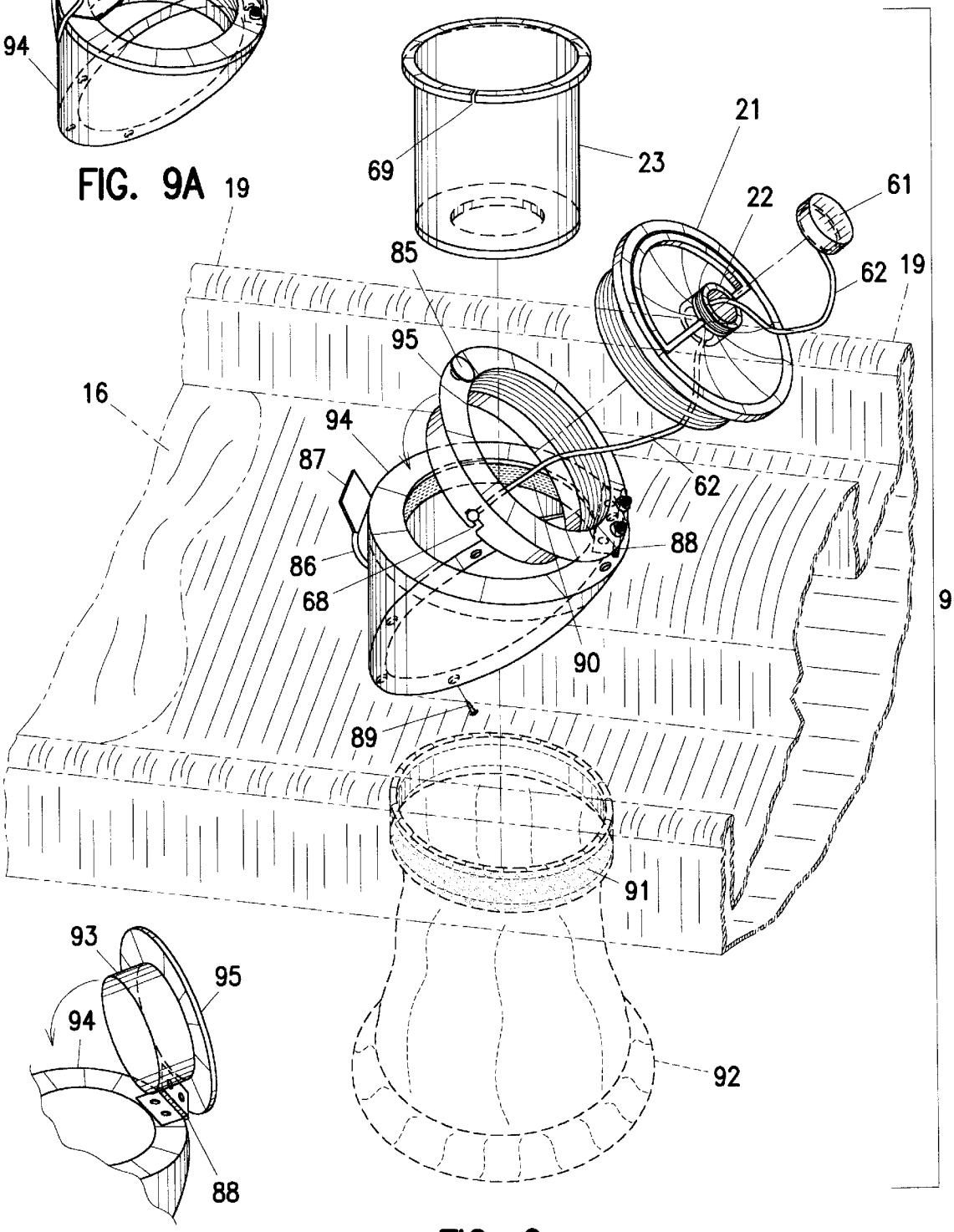
FIG. 9B
FIG. 9

INTEGRATED SAFETY ACCESSORY ARRANGEMENT AND COMPONENTS FOR USERS OF PERSONAL WATERCRAFT

CROSS-REFERENCE TO RELATED APPLICATIONS

Not Applicable

BACKGROUND

1. Field of the Invention

The present invention relates to an integrated safety accessory arrangement and components for users of personal watercraft such as kayaks, both closed hull and sit-on-top versions, as well as canoes, catamarans and similar craft.

2. Discussion of Prior Art

The provided safety features may be grouped as follows: hydration systems, navigation and communications systems, and hull pumping enhancements for closed-hull use including storage of portable manual pumps.

Personal hydration has been determined to be a critical safety factor for the full array of outdoor aerobic type sports, which includes personal watercraft paddling. An effective system should provide adequate fluid quantity, ease of access while underway, a hygienic configuration, and accommodate a variety of contemporary containers and reservoirs.

Navigation and communication are critical safety concerns for touring coastal and inland paddlers. Each paddler should be equipped with an efficient array of safety system features to reduce risks of events ranging from inconvenience to potential life threatening scenarios. Sea kayakers and those using large inland water bodies, are frequently exposed to dense fog and storms. Tidal influences are also a concern. Navigation and communication gear is necessary for safety. Currently, this gear includes: a good quality liquid filled marine compass, a GPS electronic navigation unit, a VHF receiver transmitter, an FRS radio receiver, a cell phone, and related evolving gear. Ideally, this gear must be easily accessible while underway, secured to the craft, and storable and retrievable and operable with ease.

A convenient method of pumping with the spray skirt in place, preferably with one hand, can greatly enhance safety. Personal watercraft are often used on waters where capsize self recovery may be a matter of survival. In any event, paddlers are expected to be self reliant and capable of self rescue. The most common problem in skirted cockpit closed hull watercraft such as kayaks, is that manual pumping of the flooded hull requires at least partial removal of the spray skirt to insert the pump into the hull. This compromises safety since in severe weather, storm water may enter through the skirt opening faster than it can be removed with the pump. Since emergency pumping is comparatively rare, most of the time the pump can be stored below deck in a secure location, thereby allowing other uses of the critical accessible foredeck space.

Numerous outdoor sports equipment manufacturers, such as Camelback, Blackburn, and Ultimate, provide personal hydration systems featuring flexible reservoirs and attached flexible drinking tubes. Their primary market is cyclists. These sources also provide a variety of reservoir containment packs, which include shoulder straps enabling users to carry the reservoirs on their backs and enjoy continuous access to fluids via the integral drinking tubes routed over their shoulders.

None have reservoir containment products tailored to the personal watercraft industry where the containment is installed and carried within the craft hulls.

The conventional backpack reservoir results in avoidable stress for paddlers and interferes with nominal paddling torso rotation.

The backpack configuration raises the paddler's center of gravity and reduces watercraft roll stability.

The backpack configuration conflicts with most PFD flotation devices worn by personal watercraft boaters.

The backpack style gear also presents added risks of entanglement with watercraft appurtenances during self rescue operations.

None of the kayak industry manufacturers provide internal or external features that accommodate the popular flexible reservoir hydration systems with attached flexible drinking tubes, such as used by practitioners of other outdoor sports.

None feature hull port openings for routing these drinking tubes or associated methods of sealing such openings.

Several contemporary kayak manufacturers have included molded hull deformations to accommodate securing beverage containers.

These depressions are an inch or less in depth and provide inadequate container stability.

Further, they expose virtually the whole container to sun and weather such that content temperatures are unmanaged.

Several marine supply firms market a plastic cup like beverage holder that is placed into a matching deck or other flat surface opening on watercraft.

None feature an open bottom permitting passage of a manual pump shaft.

None are designed to be integrated in a concentric installation within a system of hatch fitting safety accessories.

None have companion storage options.

None have rims slotted to recess accessory and hatch cover tethers.

None have internal non slip surface treatment to better secure beverage containers.

U.S. Pat. No. 6,050,213 (2000) Stevens, features a kayak beverage holder system integrated on the surface of the foredeck in the deck elastics. The position of this installation precludes practical concurrent use of a foredeck access hatch with or without an accessory system, significantly obstructs popular deck bags, fully exposes the beverages to sun and weather, and has no integrated system for the internal hull storage of the beverages. The recited objective of the Stevens patent is to serve beverage containers in the form of standard 12 ounce aluminum cans or slightly smaller. Larger containers are poorly served or not compatible. Prior art references and comments in the Stevens patent apply to the present invention.

Several contemporary kayak manufacturers have included molded hull platforms to accommodate after-market addition of liquid compasses.

In every case, these are situated forward of the kayaker to enable viewing the compass, however, they are all too far forward for physical access by the kayaker while underway.

None feature alternate storage for the compasses and none are designed to accommodate other kayaker accessible accessories.

Several contemporary kayak manufacturers have included standard or optional closed hull plastic access hatches with screw-in covers and pervious internal nylon fabric accessory bags. These round hatches are generally those having diameters of 12 inches or less and are not those normally provided for storage of large items and gear. U.S. Pat. Nos. 4,246,859 (1981) and 4,280,434 (1981), Beckerer, are examples. These small hull access hatches provide hull interior physical access to enable attaching nuts and washers to external accessories and features such as rails for foot pedals, deck elastic anchorages, carry handles, paddle tether anchorages, and the like. When fitted with an internal fabric bag, they are also used for the secondary purpose of providing storage for miscellaneous small items such as keys, snacks, and the like.

These hatches and covers, with and without internal bags, are provided industry wide by firms such as Beckson Marine Inc, and Viking Mfg. Company.

The accessory bags are all water pervious and therefore provide no protection for contents from bilge water.

When the hatch cover and features are integrated into a watercraft safety system, rapid one handed manipulation is critical. Ideally, the threaded cover should release in one quarter to one half turn.

The common hatch cover thread requires several full revolutions to release the cover.

The common plastic screw-in covers include molded finger depressions to allow engagement for screwing off and on.

These depressions are shallow and are difficult to use with cold fingers and or gloved hands.

None provide alternate covers accommodating internal hydration reservoirs or integral ports for access and sealing of flexible drinking tubes attached to these reservoirs.

None feature screw or other covers adapted to serve hydration, navigation, communication, or manual pump operation.

None of the available screw in hatch covers are fitted with tethers and therefore they are easily lost overboard. In storm and rough water conditions, loss of a hatch cover may result in swamping the watercraft and possible capsize.

The common plastic access hatch fittings and flanges are designed to be installed on a planar or near planar surface. Contemporary kayak fore decks slope significantly from the cockpit rim to the bow and have transverse or hinged slopes across the lateral axis.

This practically precludes use of common access hatches on kayak fore decks unless a custom platform is molded into the deck for this purpose or a custom rigid or flexible adapter is provided.

In closed hull skirted cockpit style kayaks, hull access day hatches are most often installed just aft of the seated kayaker, and just aft of the rear kayak bulkhead when present and generally on the starboard side of the hull deck.

The aft access hatch position is out of view of the seated kayaker and provides no functional platform for other accessories requiring kayaker viewing and manipulation.

None include provisions for integration of a hydration system and the related hatch cover modifications necessary to pass and seal the flexible drinking tubes.

None include hatch covers with convenient D shaped handles that facilitate use with cold and or gloved hands.

None include waterproof internal storage bags which protect the contents from exposure to bilge water.

On sit-on-top or open kayaks, these hatches are normally on the center axis of the craft, either at the seat base level of the hull immediately forward of the seated kayaker, or on a raised divider hull deck projection separating the kayaker foot wells. In the later position, the hatches are often installed at angles between thirty and sixty degrees off horizontal with the tilt such that the opening faces the kayaker.

The non-horizontal forward installations provide no suitably level platform for popular liquid filled marine compasses.

None of the forward position installations include features for mounting supplemental accessories or facilitation for hydration systems such as enhanced beverage container use or internal reservoir class hydration systems with flexible extended drinking tubes and the related hatch cover port modifications necessary to pass and seal these flexible drinking tubes or tether the port caps.

None feature internal waterproof storage bags. None feature hinged supplemental tops allowing internal storage access for the screw covers or other potential accessory adapters sized to screw in the threaded hatches.

U.S. Pat. No. 5,950,555 (1999), Damask describes a personal watercraft manual bilge pump system that features a fixed pump situated within reach of a seated kayaker, on the fore deck of the hull. It also includes a linked intake component and an optional small compass integrated into the pump handle. This pump is proprietary, fixed, and the intake system is an integral element.

It cannot accommodate common portable manual pumps, nor provide in hull storage for these pumps.

It does not accommodate integrated hydration system components such as a beverage holder or flexible reservoir and draft tube.

It cannot accept or store navigation and communication accessories.

The compass feature is permanently integrated into the small pump grip.

This compass is significantly smaller than those liquid filled marine compasses that are considered the standard of the industry for personal watercraft.

The size of the compass is limited by the integration into the pump handle.

It is not practically removable, storable, nor does the size deliver the standard of accuracy established in the personal watercraft industry.

The complex pump system and repair parts are not commonly available.

Use of this system precludes use of other critical navigation and communication accessories since it is fixed in place at the optimum foredeck location needed for access to these other accessories.

The most common manual pump in the world is the Beckson Marine Inc. model 318P1/FPS3R, a manually operated portable pump fitted with a foam rubber flotation sleeve and non ferrous compass friendly internal components. This product is retailed under a wide variety of brand names. It is highly efficient, simple, reliable, and inexpensive. Storage is normally on deck, under the foredeck elastics.

Storage under foredeck elastics is accessible, however it is not as secure as in hull storage and uses space needed for storage and other accessories.

Pumping out a flooded watercraft hull requires partial removal of the kayaker's spray skirt, thereby exposing the hull to more storm water.

Pumping in this manner also requires both hands. This precludes simultaneous use of a low paddle brace position which is often necessary to avoid recapsizing in rough waters.

SUMMARY

The present invention is an integrated safety accessory arrangement and components for users of personal watercraft which provides solutions to needs unmet by prior art. Said arrangement includes features addressing boater personal hydration, mounting and storage of navigation and communication accessories, and concurrently facilitates one handed emergency use of common portable manual pumps and storage thereof within a closed hull kayak.

OBJECTS AND ADVANTAGES

Accordingly, several objects and advantages of the present invention are:

The main object is to provide an integrated personal watercraft safety accessory system of the character described which obviates the disadvantages noted in the previous prior art discussion.

A further object of the present invention is to provide an integrated safety system of the character described in which a personal watercraft boater has easily accessible and functional options for a broad variety of personal hydration options while underway. More particularly, alternatives serving both a broad array of common rigid beverage containers in a fashion where unanticipated emergency hull pumping will be facilitated. Additionally said system will accommodate larger capacity flexible hydration reservoir systems fitted with flexible drinking tubes, in hull containment for such reservoirs, and hull porting and sealing of the associated drinking tubes. Both port caps and hydration system adapted hatch covers are fitted with tethers to avoid loss overboard.

The advantages of the present invention include an integrated system of complimentary components providing paddlers with convenient easily accessible personal hydration alternatives. These include accommodation of a broad array of common rigid beverage containers as well as all contemporary flexible reservoir class hydration systems. The invention allows rapid transition from rigid beverage container use to emergency hull pumping through insertion of a manual pump. The present invention also provides less environmental exposure to beverages thereby reducing risks of contamination and improves temperature stability. The in hull compartment for the flexible hydration reservoir avoids paddler's physical stress, avoids impaired ability to paddle effectively, lowers the personal watercraft center of gravity thereby enhancing roll stability, reduces risk of equipment entanglement during capsize recovery, and retains the sealed hull integrity.

Another object of the present invention is to provide an integrated safety system of the character described in which a variety of safety oriented navigation and communication accessories including but not limited to GPS devices, VHF transmitter receiver radios, FRS receiver radios, cell phones, liquid or electronic marine compasses, and the like, can be accessible, useable, manipulatable, and storable, within reach of the boater while underway.

The advantages of the present invention include provisions for use of a broad array of personal watercraft navigation and communication devices in a position easily accessible, useable, storable, and retrievable, while underway. The present invention includes tethers securing the various hatch cover mounted accessories to avoid loss overboard. The present invention provides alternate storage options for the various hatch cover mounted accessories. Dependant on embodiment, these include in hull mounting rings and waterproof storage bags integrated into accessory hatches. A further advantage in the present invention is the provision of a D handle on the hatch covers to facilitate removal and replacement with cold and or gloved hands even without visual observation, thereby enhancing the rapid manipulation often necessary for safety.

Another object of the present invention is to provide an integrated safety system of the character described in which the sport's common portable manual pumps can be safely utilized for one handed pumping with a fully sealed kayaker spray skirt in place and provisions for storage of said pumps within the watercraft hull when not in use or when need is not imminent.

Advantages of the present invention include provision of accessory components and companion use of standard watercraft features which collectively enable one handed emergency use of common manual pumps while cockpit spray skits are fully sealed in position. Included are a beverage holder for rigid containers having an open bottom allowing passage of the pump shaft, a permeable open bottomed fabric sleeve allowing unrestricted water flow to the pump, an anti rotation component keeping the pump in near vertical position, and use of common watercraft foredeck elastics to restrain the manual pump in place while pumping. An integrated pump holder provides secure in hull storage for a portable manual pump. The pump holder includes a friction feature that retains the pump in the holder and allows release when withdrawn. The position of the integrated pump holder avoids conflict with paddler activities including ingress and egress.

Further objects and advantages of my invention will become apparent from a consideration of the drawings and ensuing description.

DRAWING FIGURES

In the drawings, closely related figures have the same number but different alphabetical suffixes.

Figure 1B:
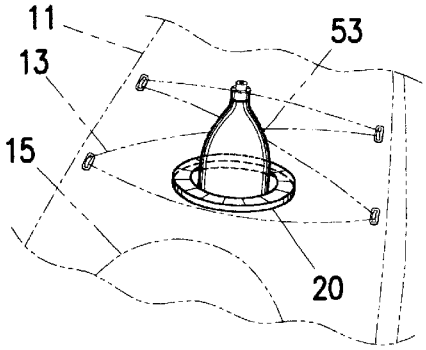
Figure 1C:
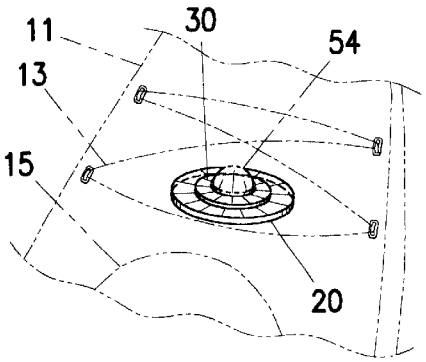
Figure 1:
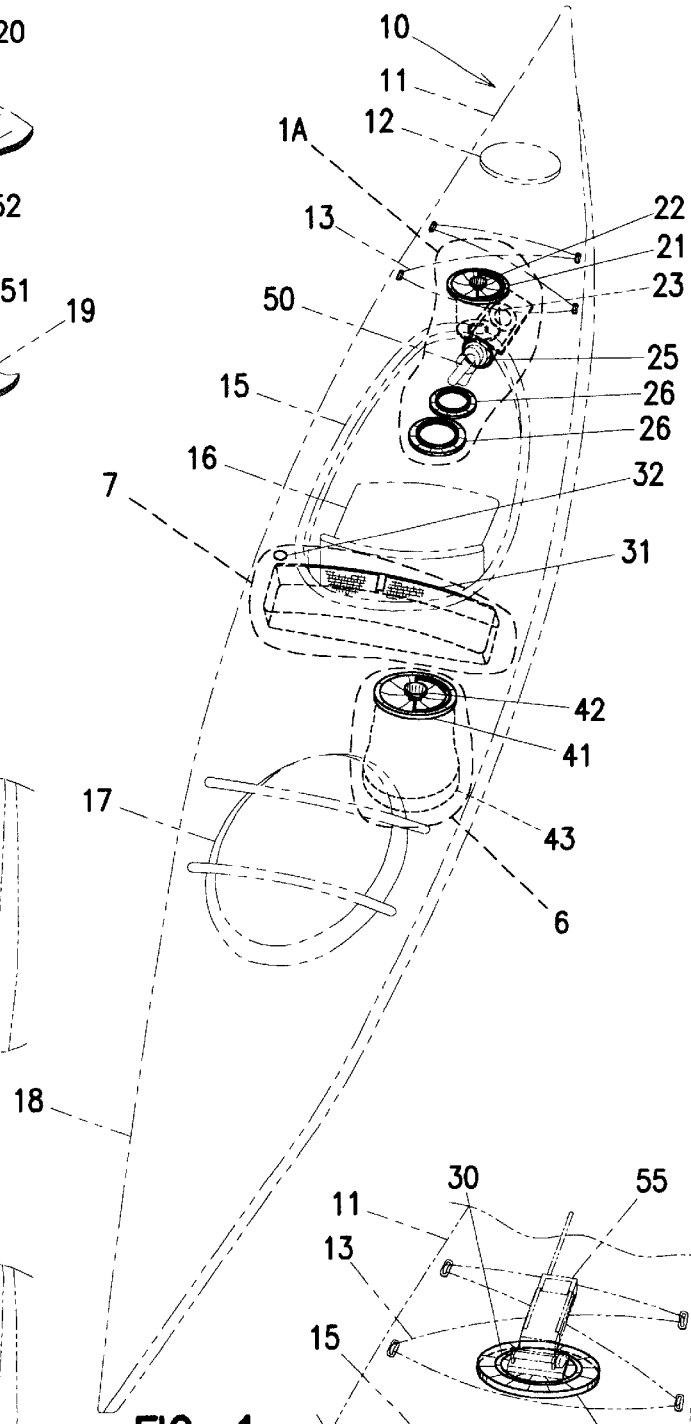
Figure 1D:
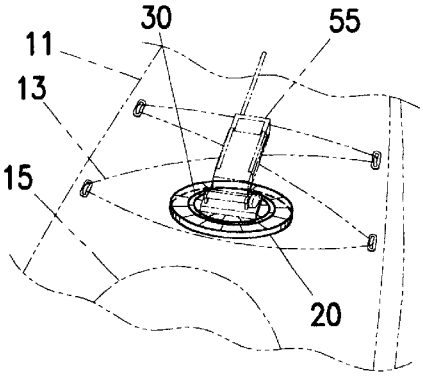
Figures 2, 2A:
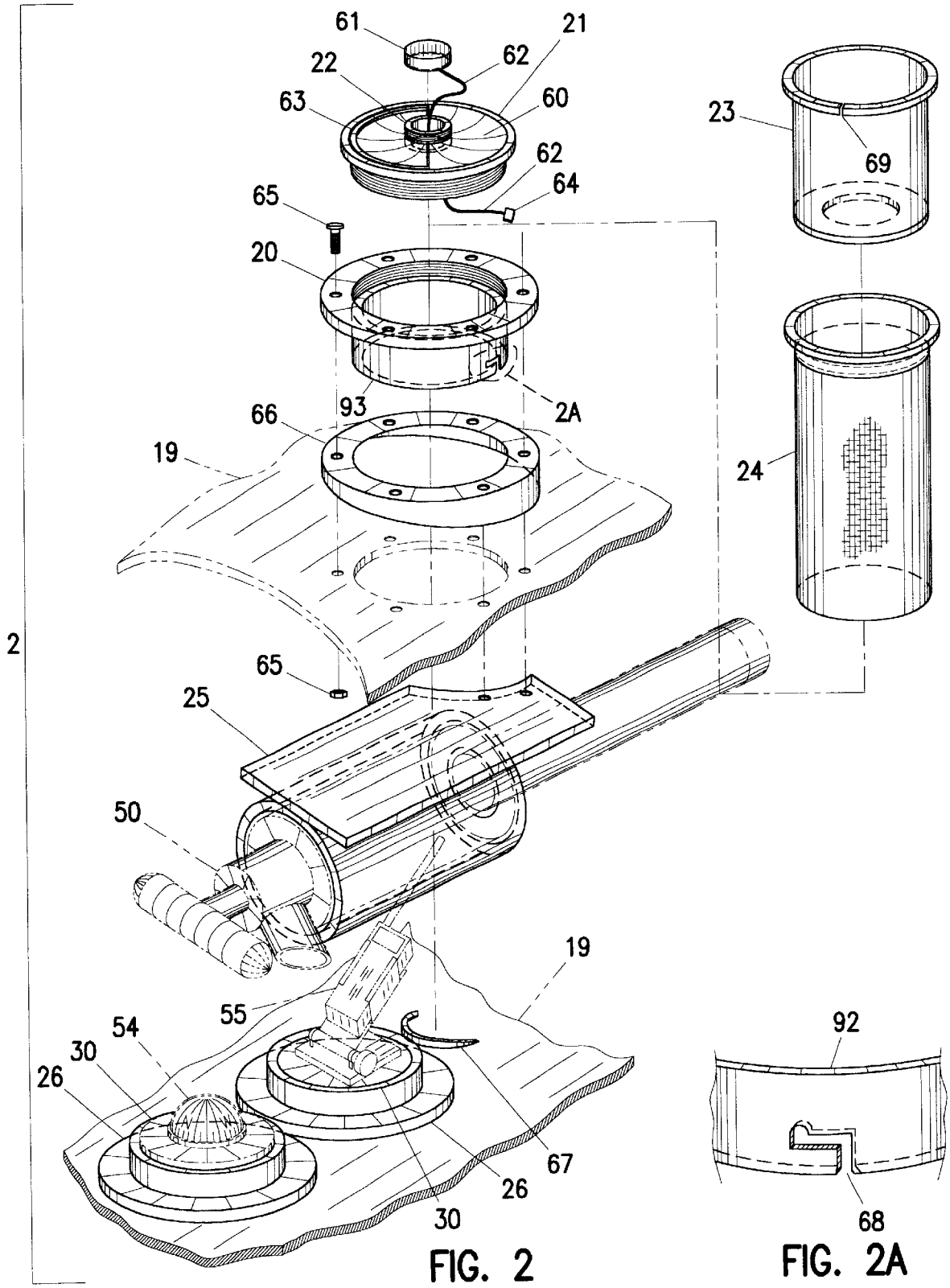
Figure 3:
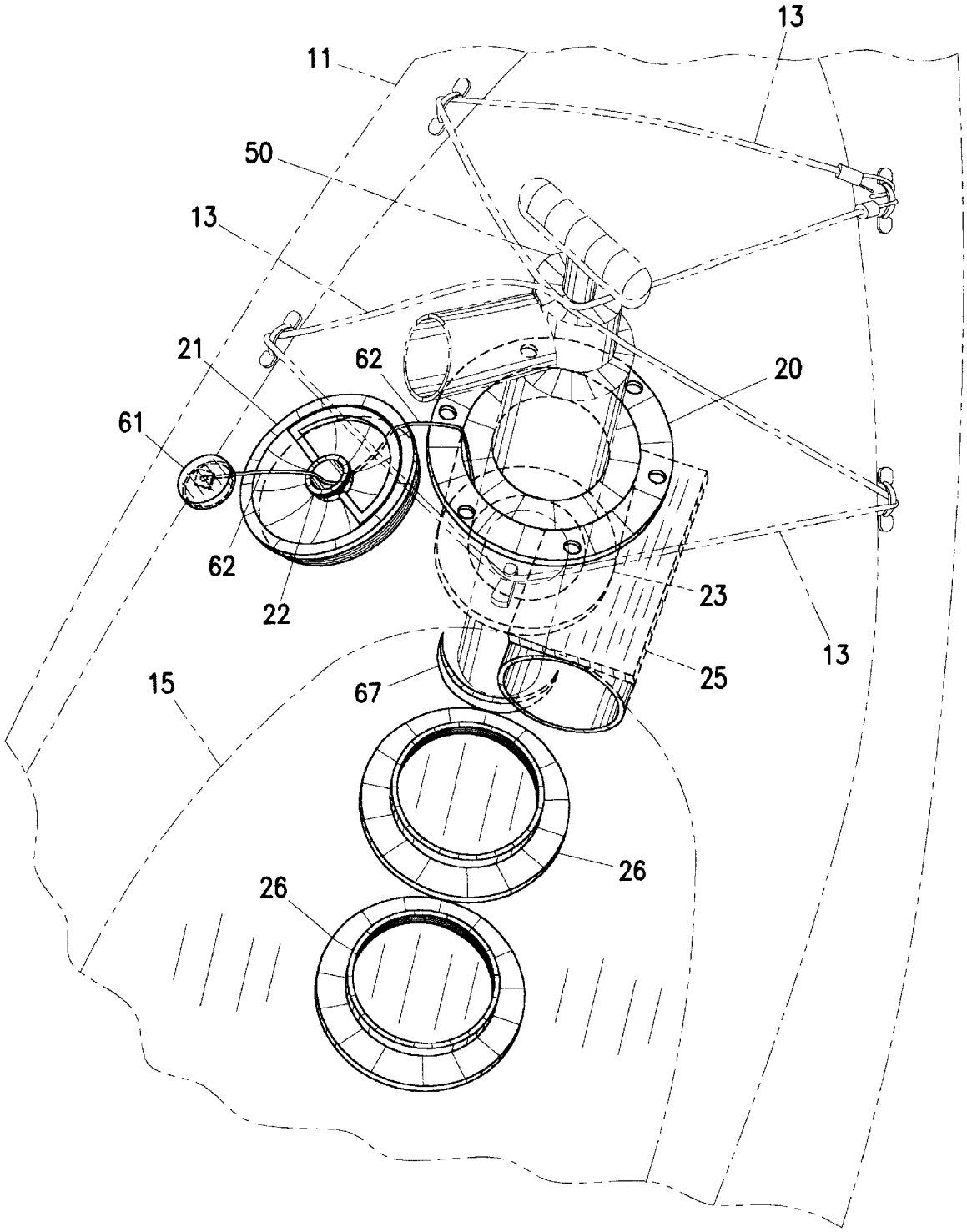
Figure 4:
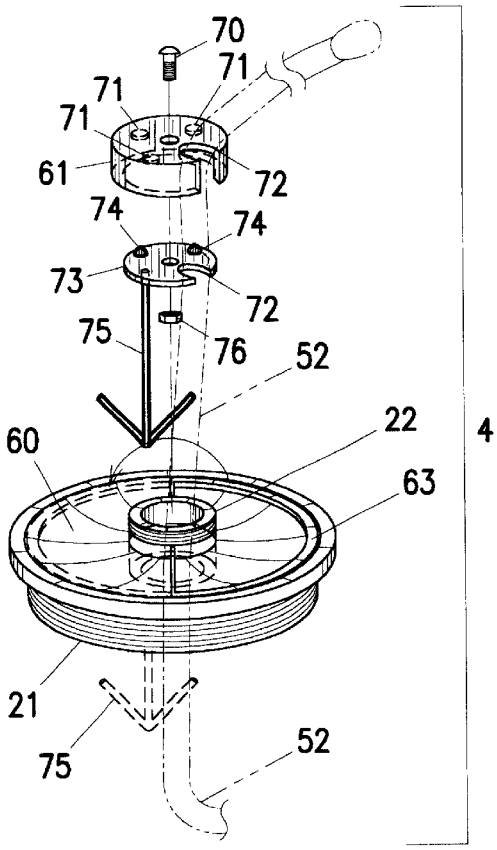
Figure 4A:
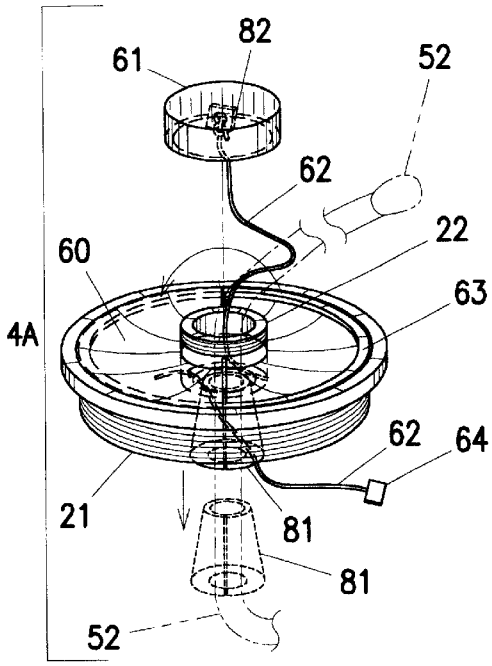
Figure 4B:
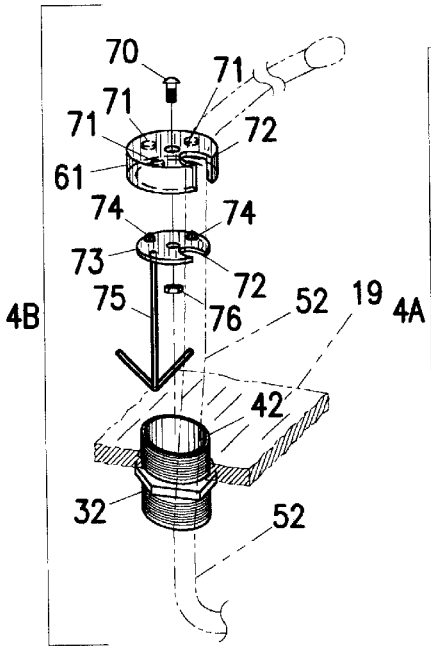
Figure 4C:
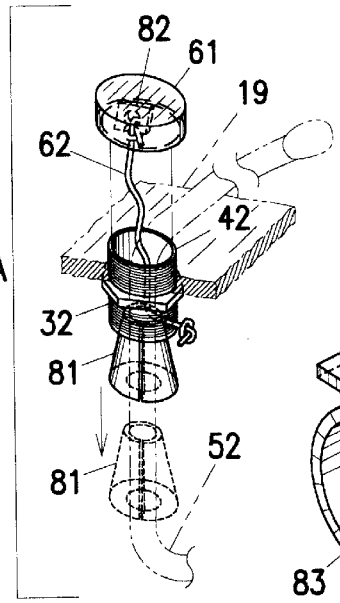
Figure 5:
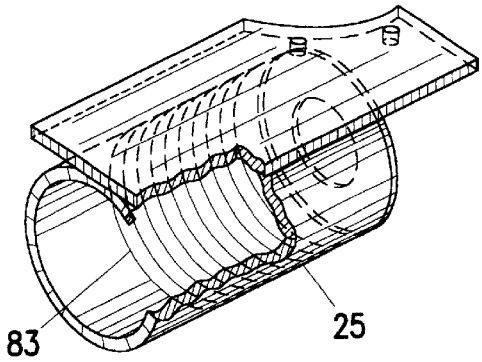
Figure 6:
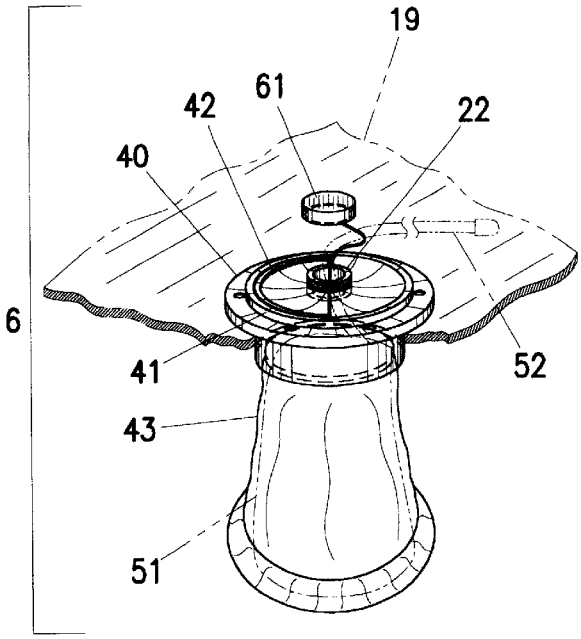
Figure 6A:
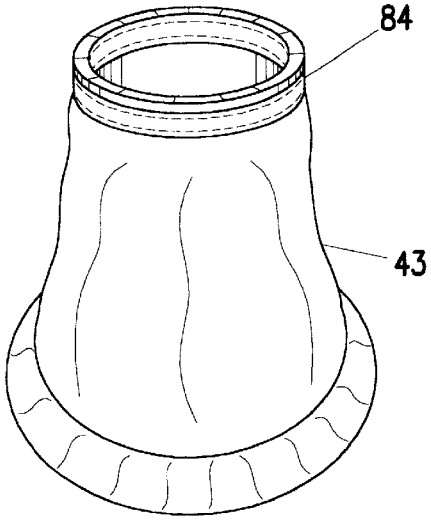
Figure 7:
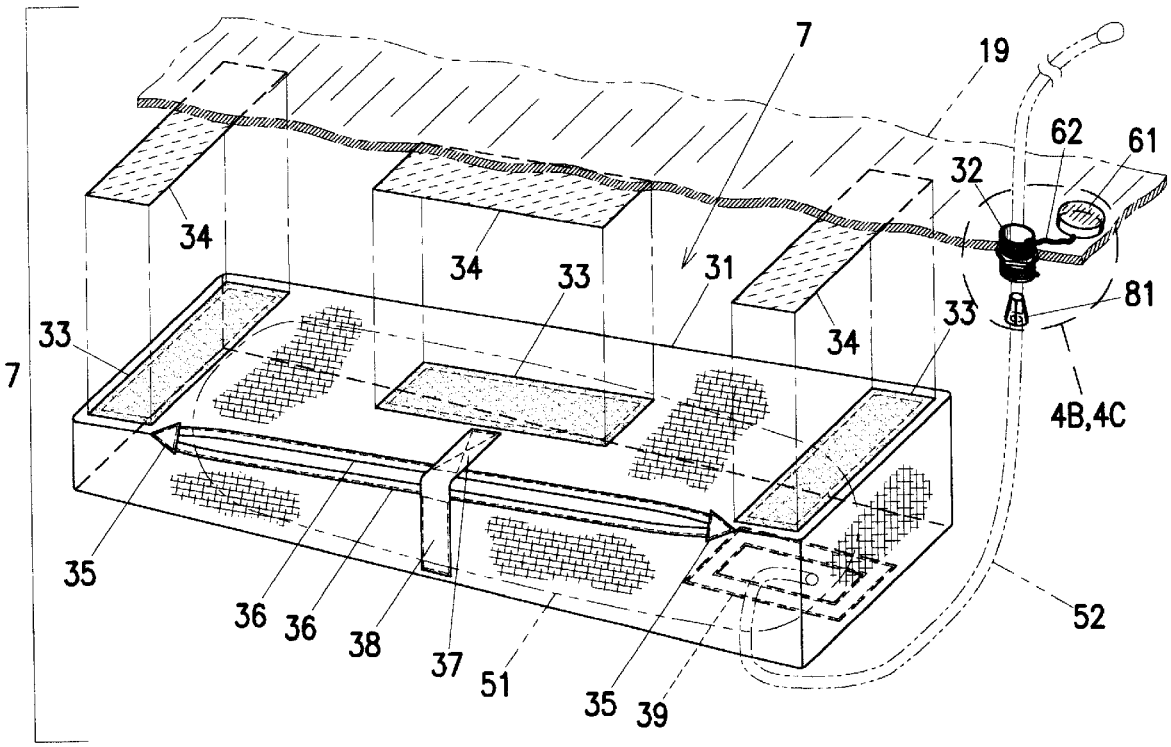
Figure 8A:
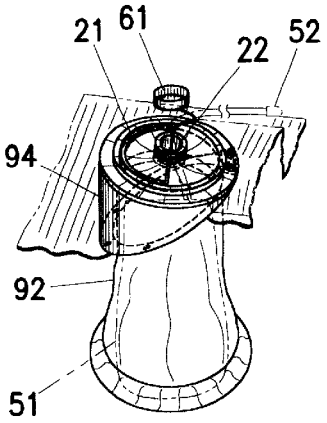
Figure 8B:
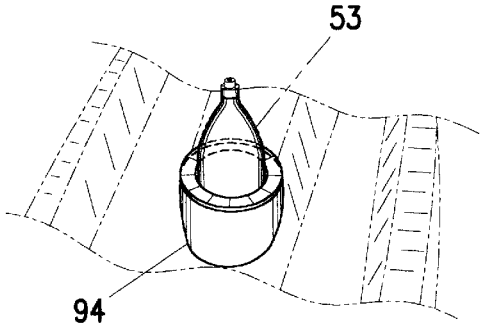
Figure 8:
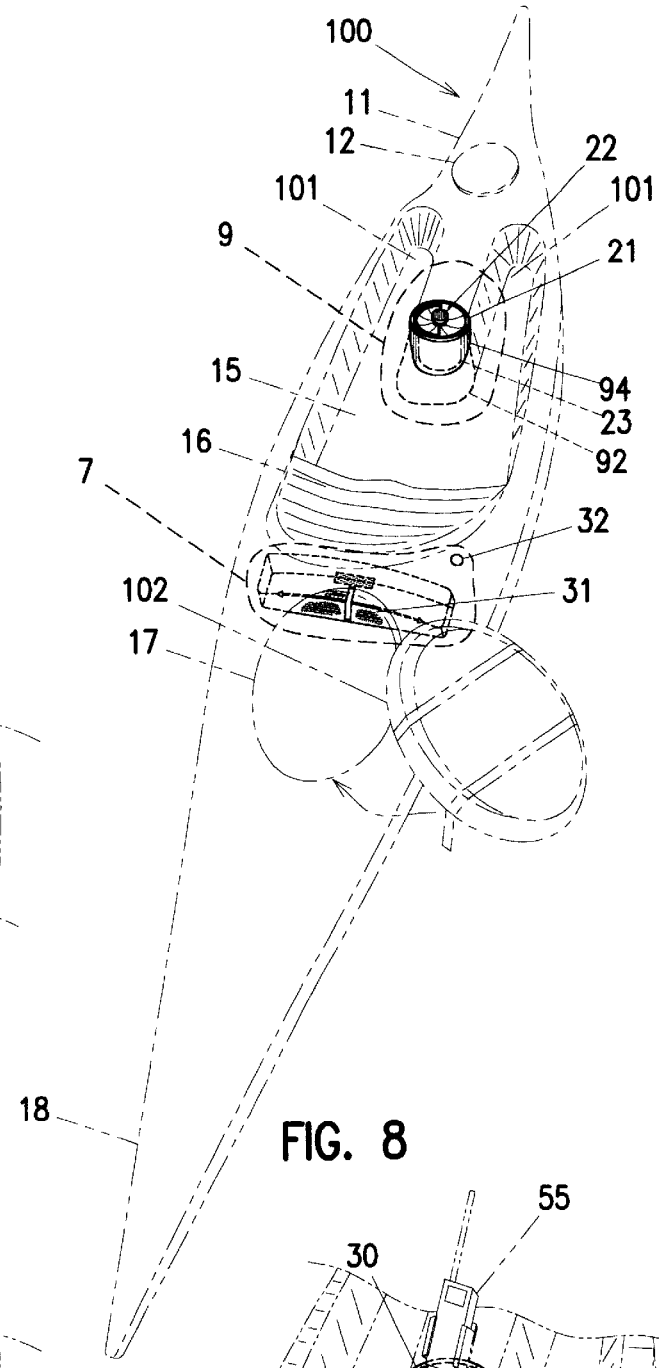
Figure 8C:
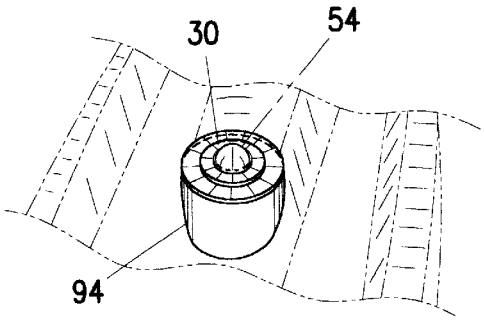
Figure 8D:
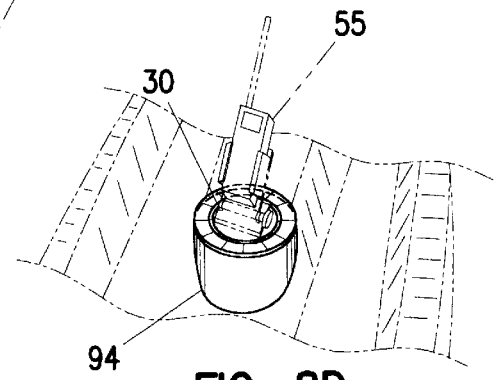

FIG. 1 is a top perspective view of a conventional closed hull kayak personal watercraft FIG. 1A is a cut-out perspective of accessory hatch and appurtenances FIG. 1B is a cut-out perspective of sports bottle in accessory hatch FIG. 1C is a cut-out perspective of a marine compass in accessory hatch FIG. 1D is a cut-out perspective of a typical electronic accessory in accessory hatch FIG. 2 is an exploded view of the primary accessory hatch system FIG. 2A is a cut-out of the accessory hatch tether anchorage slot FIG. 3 is accessory hatch system with portable manual pump in pumping position FIG. 4 is an exploded view of hydration hatch cover and sub-port components FIG. 4A is an alternative embodiment of hatch cover port seal method FIG. 4B is and exploded view of hull port system FIG. 4C is an alternate embodiment of hull port seal system FIG. 5 is portable pump holder FIG. 6 is cut-away of hip-hatch system assembly FIG. 6A is waterproof bag in hip-hatch assembly FIG. 7 is the hydration bladder compartment FIG. 8 is perspective view of a sit-on-top kayak personal watercraft FIG. 8A is a cut-away of the sit-on-top version of the accessory hatch system FIG. 8B is a cut-out perspective of sports bottle in accessory hatch FIG. 8C is a cut-out perspective of a marine compass in accessory hatch FIG. 8D is a cut-out perspective of a typical electronic accessory in accessory hatch FIG. 9 is an exploded view of the sit-on-top version of the accessory hatch system FIG. 9A is a cut-out of portions of the hatch adapter FIG. 9B is a cut-out of the hatch and adapter showing hinge function

DRAWING REFERENCE NUMERALS

10 is a closed hull kayak class personal watercraft
11 is bow of kayak
12 is forward cargo hatch
13 is foredeck elastics
15 is kayak cockpit
16 is kayak seat
17 is kayak aft cargo hatch
18 is stern of kayak
19 is kayak hull
20 is foredeck accessory hatch
21 is accessory hatch cover for hydration port version
22 is the accessory hatch cover hydration tube port
23 is the beverage holder
24 is the hydration reservoir containment sleeve
25 is the holder for the portable manual pump
26 is the storage ring for various hatch cover mounted accessories
30 is the accessory hatch cover for mounting accessories
31 is the hydration system reservoir compartment
32 is the hydration system reservoir drinking tube hull port
33 is Velcro attachment strips sewn to hydration compartment
34 is Velcro strips for attaching to kayak hull
35 is hydration compartment opening reinforcement
36 is hydration compartment opening
37 is hydration compartment latch strap
38 is hydration compartment latch strap Velcro
39 is hydration compartment reservoir draft tube opening
40 is the aft deck accessory hatch
41 is the aft deck accessory hatch cover
42 is the aft deck accessory hatch cover bail handle
43 is the aft deck accessory hatch waterproof storage bag
50 is portable manual pump
51 is flexible hydration reservoir
52 is flexible hydration reservoir draft tube
53 is typical hydration sports bottle
54 is typical mounted marine compass
55 is typical mounted electronic accessory
60 is hydration version hatch cover bail handle depression
61 is sub-port cap
62 is tether cord
63 is hydration hatch cover bail handle
64 is hatch cover tether cord anchorage button
65 is accessory hatch mounting fastener
66 is compressible accessory hatch adapter
67 is portable pump rotation restraint
68 is tether cord anchorage slot
69 is slot in sub-port cap for draft tube
70 is sub-port cap disk fastener
71 is sub-port cap orientation detent
72 is sub-port draft tube slot
73 is sub-port sealing disk
74 is sub-port sealing disk orientation projection
75 is sub-port cap assembly self-latching anchorage tether
76 is sub-port sealing disk fastener nut
81 is alternate support tube seal
82 is sub-port tether cord cap anchorage aperture
83 is pump holder friction anchorage
84 is aft hatch waterproof bag retention ring
85 is sit-on-top hatch anchorage pin
86 is sit-on-top hinged hatch anchorage shock cord
87 is sit-on-top hatch anchorage cord tab
88 is sit-on-top hatch hinge
89 is sit-on-top rigid hatch adapter fastener screw
90 is Velcro suspension anchorage on water proof bag for sit-on-tops
91 is Velcro suspension anchorage on sit-on-top adapter for storage bag
92 is sit-on-top waterproof storage bag
93 is cylindrical projection of typical accessory hatch
94 is sit-on-top rigid hatch adapter
100 is sit-on-top style kayak personal watercraft

DESCRIPTION—FIGS. 1, 1A, 1B, 1C, 1D, 2, 2A, 3, 4, 4A, 4B, 4C, AND 5, PREFERRED EMBODIMENT

The preferred embodiment of the integrated safety accessory arrangement and components for users of personal watercraft features a closed-hull sea kayak 10 with a foredeck accessory hatch 20 accessible to the boater while underway. Features include:

Flexible contoured hatch adapter 66 placed between kayak hull 19 and accessory hatch 20 flange allows conformance with various kayak hulls 19.

Machine screws 65 secure hatch 20, adapter 66, and pump holder 25 to hull 19.

Kayak hull 19 platform molded to nearly level configurations and having diameter equal or greater than accessory hatch 20 eliminates requirement for kayak accessory hatch flexible adapter 66.

Nested concentric internal hatch components include a beverage holder 23 and a permeable fabric sleeve 24 for containment of a flexible personal hydration reservoir 51. The beverage holder 23 and hydration containment sleeve 24 both have openings permitting insertion and operation of pump 50.

Pump rotation restraint 67 resists rotation of the pump 50 and is attached with adhesive to the interior hull 19 bottom directly below the hatch opening.

Pump 50 is held in place during pump use by deck elastics 13 which are stretched over pump 50 upon insertion and prior to pumping.

Cover 21 includes a D shaped hinged opening handle 63 and recesses 60 facilitating gloved hand grasping as well as flush exposure when in relaxed position.

Tether cord 62 is permanently fastened to cover 21. Tether cord 62 is attached to cover 21 by passing cord 62 through a near center aperture in port 22 and knotting the end. The opposite end of cord 62 is fitted with a weighted button like end piece 64. Hatch 20 cylinder 93 has an L shaped slot 68 beginning in the lower perimeter of the cylindrical projection of the hatch placed into kayak hull 19. Cord end piece 62 is placed into slot 69 and slid to end of slot with end piece 62 outside hatch 20 cylindrical projection 93. This effectively anchors tether cord 62 while allowing easy removal.

Hatch cover 21 includes a hydration tube sub-port 22 sized to allow passage of a flexible hydration tube 52. Sub port cap 61 is fitted with a circular opening sized to allow passage of flexible hydration tube 52. The opening is positioned such that the perimeter is tangent to the exterior perimeter of cap 61 leaving a tube diameter gap on the cylindrical rim of cap 61. Cap 61 interior is fitted with a center mounted internal rotateable disc 73 slotted at one location to allow passage of the hydration tube 52. When the tube 52 is not in use, disc 73 may be rotated enough to misalign the opening and when cap 61 is tightened, disc 73 then completes the seal of cap 61. Sub port cap 61 has three depressions 71 on the underside. These are positioned at 90 degree positions beginning with the tube port slot. Internal disk 73 includes two dome shaped orientation projections 74 matching cap detents 71. When disk 73 is rotated such that tube opening 72 matches cap opening 72, one projection 74 aligns with depression 71. When disk 73 is rotated 90 degrees from the open tube position, projection 74 aligns with cap depression 71 thus restraining free movement of disk 73 while tightening cap 61 and sealing cap 61 at tube slot opening 72. Flexible projection 75 is attached or integrated into disk 73 and extends in shaft fashion away from cap 61 and terminated with two or more upwardly angled flexible winged projections having external tips wider than port opening 22. When projection 75 is forced into sub port cap opening 22, flexible winged projections 75 flex to pass opening and then expand to their rest position which prevents removal without considerable force and thus serving as a tether for cap 61.

Accessory hatch cover 30 has no handle 63 and serves to accept mounts for navigation and communication accessories such as a liquid filled marine compass 54, and hand held radios such as VHF, FRS, cell phones, 55 and the like.

Covers 21, and 30, including mounted accessories 54, 55, may be stored within the kayak hull 19 on storage rings 26 having matching threads. Storage rings 26 are attached to hull 19 with adhesive.

Pump storage holder 25 is mounted integrally with the accessory hatch 20 within the interior of the kayak hull 19. Pump holder 25 includes an internal friction material 83 which retains pump 50 in place and releases upon force of withdrawal. Stored pump 50 is easily accessible and does not conflict with necessary kayak operation.

FIGS. 6 and 6A—ADDITIONAL EMBODIMENTS

An additional embodiment provides aft accessory hatch 40 having the following features:

Opening large enough to pass covers 21 and 30 and removable internal waterproof storage bag 43 which provides dry storage for covers 21 and 30 as well as an alternate functional position for flexible reservoir 51.

Aft accessory hatch 40 is situated just aft of the seated boater and within reach while underway.

Aft accessory hatch cover 41 is fitted with a tether 62, sub-port 22, sub-port cap 61 all of which are essentially identical and interchangeable with similar features on foredeck accessory hatch 20. D-handle 42 is functionally identical with handle 63 except for size.

FIG. 7—ADDITIONAL EMBODIMENT

An additional embodiment provides another alternative for functional location and operation of personal hydration system flexible reservoir 51 and attached flexible drinking tube 52. Features include:

Hydration compartment 7 is fabricated from vinyl mesh fabric which avoids retention of spillage and is compressible when adjacent cargo requires more space.

Compartment 7 has a slope in the bottom fabric which insures that reservoir liquids will fully drain to draft tube 52.

Compartment 7 opening 36 is reinforced with marine grade vinyl along edges and at ends 35 and reinforced tube 52 opening 39

Compartment 7 is latched closed with nylon strap 38 which is sewn to compartment 7 on one end, and Velcro latched on the other.

Compartment 7 is installed within hull of closed-hull kayak 10 or sit-on-top kayak 100. Compartment 7 may be installed forward of and accessed through, aft cargo hatch 17 or alternatively, aft of seat 16, accessed through cockpit 15. Compartment 7 is accessed through aft hatch 17, or, when in alternate position aft of seat 16, compartment 7 is accessed through cockpit 15. Attachment of compartment 7 is Velcro strips 33 sewn to compartment 7 and matching Velcro attachment strips 34 which are attached to the interior kayak hull with adhesive.

Flexible hydration drinking tube 52, fixed to flexible hydration reservoir 51, is routed through a reinforced opening 39 in hydration compartment 7 and then through hull port opening 32.

Hull port opening 32 is fitted with disk 73 aperture port cap 61 assembly which is essentially identical and interchangeable similar components in the primary embodiment.

FIGS. 8, 8A, 8B, 8C, 8D, 9, 9A, AND 9B—ADDITIONAL EMBODIMENTS

An alternative embodiment adapts the integrated safety accessory arrangement system to sit-on-top class kayak 100 and includes the following variations and additions:

Rigid plastic hatch adapter 94 shaped to conform with available kayak surface configurations accessible while underway and including a top having a nearly level plane.

Rigid hatch adapter 94 is fastened to kayak 100 hull 19 with sheet metal screws 89.

Kayak 100 hull platform molded to nearly level configurations and having diameter equal or greater than accessory hatch 95 allows the hatch mounting adapter 94 to be reduced to a simple annular ring with fastening features and hinge 88.

Adapter 94 includes hinged hatch 95 which allows access to waterproof storage bag 92 which is attached through use of Velcro 90 around the exterior top circular perimeter of storage bag 92 and matching Velcro material 90 placed around the upper interior circumference of adapter 94.

Opening is sized to allow insertion of various mounted accessory hatch covers 30 and 21 and reservoir 50.

Accessory hatch 95 is mounted to adapter 94 using a brass hinge 88. Other non ferrous hinge materials may be substituted.

Hatch 95 is secured in position using shock cord 86 which is fitted with pull tab 87 and when tensioned reaches over latch button 85 on hatch 95.

Hatch 95 is fitted with internal beverage holder 23, tethered hydration hatch cover 21 with hydration sub-port 22, cap 61, and various tethered mounted accessory hatch covers 30 all of which are essentially identical and interchangeable with similar components in the primary embodiment.

FIGS. 4A AND 4C ALTERNATIVE EMBODIMENTS

Flexible hydration tube 52 seal at the sub-port 22 and hull port 32 features:

Rubber stopper 81 bored axially to fit tube 52 and sized to wedge into bottom of hull port 32 and hatch cover sub-port 22, and split full length to allow fitting over tube 52 serves as an alternate seal to disk 73 and appurtenances as shown in FIGS. 4 and 4B.

Sub-port cap 61, secured by tether 62, knotted through an aperture in sub-port 22 or hull port 32 on one end, and tied to cap 61 anchorage aperture 82 on the other, substitutes for flexible tether anchorage 75.

Operation—Figures as Designated

Operation of the integrated safety accessory arrangement and components for users of personal watercraft include the following procedures:

For Closed-Hull Kayak 10, FIGS. 1, 1A, 1B, 1C, 1D, 2, 2A, 3, 4, 4A, 4B, 4C, 5, 6, 6A, AND 7.

Accessory hatch 20, hydration hatch cover 21, reservoir sleeve 24, and beverage holder 23, are optimally assembled as follows:

Hatch cover tether 62 is inserted into tether slot 68, then sleeve 24 is inserted into hatch 20, then, concentrically, beverage holder 23 is inserted, then hatch cover tether 62 is depressed into the slot provided in the rim of beverage holder 23, then hydration hatch cover 21 is screwed into hatch 20.

Hatch cover 21 sub-port 22 has a permanently attached cap tether 73. Cap 61 flexible self-locking tether 75 is forced into sub-port 22 until compressible wings expand after passage. Prior to screwing cap 61 onto sub-port 22, disk 73 is rotated to close slot 69. Cap 61 is then screwed onto sub-port 22.

For descriptive purposes, this is the standard condition.

Hydration Features

Beverage Holder

To utilize rigid beverage container holder 23, boaters unscrew standard hydration hatch cover 21, or alternate accessory hatch cover 30, whichever may be in use, and allow it to hang aside on the attached tether 75. This exposes beverage holder 23 which then may be used to contain a wide array of common rigid personal beverage containers ranging from common 12 ounce metal containers, disposable plastic sports bottles to 24 ounce capacity, coffee cups, metal thermoses, etc. having a base diameter of 3 inches or less preferably without handles or with handles having an attachment 3.5 inches or more above the plane of the base. Beverage holder 23 feature is ready for use. When beverage containers are not in beverage holder 23, they may be stored unconstrained within hull 19, or secured in optional storage bag 43.

Flexible Hydration Reservoir with Drinking Tube

From the standard condition, unscrew hydration hatch cover 21, remove beverage holder 23, insert flexible hydration reservoir 51 into retention sleeve 24, unscrew hatch cover sub-port cap 61, allowing it to hang aside on its tether 62, insert attached drinking tube 52 through the open support 22, rotate cap disc 73 to allow passage of the drinking tube 52 through sub-port cap 61 slot 69, and screw sub-port cap 61 onto sub-port 22. The hydration reservoir feature is sealed and ready for use. To remove, reverse procedure. When reservoir 51 is not in use, it may be stored in place, with the drinking tube 52 retracted within sleeve 24, or alternatively, stored in optional storage bag 43.

Alternatively, the hydration reservoir 51 with drinking tube 52 may be placed in storage bag 43 within aft accessory hatch 40, and tube 52 routed and sealed as described previously.

Alternatively, hydration reservoir 51 with drinking tube 52, may be inserted into compartment 31, drinking tube 52 then is routed through compartment opening 39, and then through hull port 32, and through hull port cap 61, in the same fashion as described previously. This procedure applies whether compartment 31 is installed for access via the aft cargo hatch 17, or behind the seat 16 ahead of the bulkhead.

An alternative tube 52 seal is effected as shown in FIGS. 4A and 4C. With this alternative, cap 61 has no slot 69 disk 73, or flexible tether 75. In lieu, stopper seal 81 is snapped over tube 52, with the smaller end diameter toward the invert side of sub-port 22 or hull port 32, as applies. Seal 81 is forced into the respective port to make the seal. Alternate cap 61 is secured by fixed tether 62 as shown.

Navigation and Communication Accessories

From the standard condition, unscrew hydration hatch cover 21, remove beverage holder 23, remove hydration retention sleeve 24, detach hatch cover tether 62, store removed cover 21 either on hull storage ring 26, or optionally, within storage bag 43.

Select hatch cover mounted accessory 54 or 55 from storage position on storage ring 26 or storage bag 43 and insert tether 62 into hatch tether slot 68, insert sleeve 24, insert beverage holder 23, rotate beverage holder 23 to align rim slot 69 with tether 62, depress hatch cover tether 62 into beverage holder slot 69, screw hatch cover mounted accessory 54, or 55 into hatch 20.

Selected accessory is available for use. To remove and store, reverse procedure.

Emergency Pumping of Hull using Portable Manual Pump

Unscrew accessory hatch hydration cover 21 or accessory hatch cover 30, whichever is in use, and allow it to hang by the attached tether 62.

Withdraw portable manual pump 50 from pump holder 25, or remove from under deck elastic 13, as applies, and insert pump 50 into hatch 20, through the opening in the beverage holder 23 and hydration retention sleeve 24. Depress pump 50 into hatch 20 until firmly in contact with interior hull 19 bottom.

Draw forward deck elastics 13 back over pump 50 and place over pump 50 top, avoiding conflict with pump 50 handle and shaft.

Secure paddler's spray skirt.

Proceed with one hand pumping.

Upon completion, reverse procedure resulting in stored pump.

Should hydration reservoir 51 be in use, follow same procedure described above, then withdraw reservoir 51 and hang aside on flexible drinking tube 52 prior to inserting pump 50.

For Sit-On-Top Kayak 100, FIGS. 2A, 4, 4A, 4B, 4C, 7, 8, 8A, 8B, 8C, 8D, 9, 9A, AND 9B Accessory hatch 95, hydration hatch cover 21, which includes support 22, sub-port cap 61 with tether 75, hatch adapter 94, hinged top 95, top latch 86, top latch anchor pin 85, storage bag 92, beverage holder 23, are optimally assembled as follows:

Unlatch hatch 95 by grasping elastic latch loop tab 87 and stretching cord 86 to release the loop from latch anchor pin 85, tilt hinged hatch 95 back, insert storage bag 92 attaching the perimeter Velcro 91 to matching Velcro 90 situated around the upper perimeter of hatch adapter 94 Close hinged hatch 95 and secure with tabbed elastic latch 86 over latch anchor pin 85.

Hatch cover 21 tether 62 is inserted into hatch tether slot 68, then insert beverage holder 23, then hatch cover tether 62 is depressed into the slot 69 provided in the rim of beverage holder 23 after rotation of holder 23 to match tether alignment, then hydration hatch cover 21 is screwed into hatch 95.

Hatch cover 21 sub-port 22 cap 61 has a permanently attached tether 75. Operation is essentially identical with that described for kayak 10.

For descriptive purposes, this is the standard condition.

Hydration Features

Beverage Holder

Operation is identical to that described for closed-hull kayak 10. When beverage holder 23 containers 53 are not in use, all may be stored within the internal storage bag 92, accessed through opening hinged hatch 95.

Flexible Hydration Reservoir with Drinking Tube

From the standard condition, unscrew hydration hatch cover 21 allowing it to hang aside on tether 62, remove beverage holder 23, unlatch hinged hatch 95 and insert beverage holder 23 into storage bag 92. Withdraw flexible drinking tube 52 from flexible reservoir 51 which is stored within storage bag 92. Direct drinking tube 52 through bottom opening of hatch 95, close and latch. Insert flexible tube 52 through hydration hatch cover port 22, and complete procedure as described for closed-hull kayak 10.

Hydration reservoir feature is ready for use. To remove, reverse procedure. When reservoir 51 is not in use, it may be stored in place, with the drinking tube 52 retracted within storage bag 92.

Alternatively, hydration reservoir with drinking tube 51, may be inserted into compartment 31, drinking tube 52 then is routed through compartment opening 39, and then through hull port 32, and through hull port cap 61, in the same fashion as described for kayak 10.

Alternative tube 52 seal 81, as shown in FIGS. 4B and 4D is operated identically to the description for kayak 10.

Navigation and Communication Accessories

From the standard condition, unscrew hydration hatch cover 21, remove beverage holder 23, detach hatch cover tether 62, store removed cover 21 within storage bag 92.

Select hatch cover mounted accessory 54 or 55 from bag 92, close and latch hinged hatch 95, insert tether 62 into hatch tether slot 68, insert beverage holder 23, rotate beverage holder 23 to align rim slot 69 with tether 62 position, and continue procedure as described for closed-hull kayak 10.

Selected accessory 54 or 55 is available for use. To remove and store, reverse procedure.

For Canoes

Hatch 95 and storage bag 92 are installed into top side canoe horizontal hull brace and adapter 94 is reduced to an annular mounting ring for attachment of hinge 87. Operation and features are identical to sit-on-top kayak 10 data.

For Catamaran

Hatch 95 and storage bag 92 are installed into top of catamaran hull at a user accessible location. Adapter 94 is reduced to an annular mounting ring for attachment of hinge 87. Operation and features are identical to sit-on-top kayak 10 data.

Conclusion, Ramifications and Scope

Accordingly, the reader can see that this integrated safety accessory arrangement and components for users of personal watercraft offers an integrated system with an array of alternatives which may be tailored to an individual paddler's needs and specific personal watercraft configuration. An optimum configuration would include the foredeck accessory hatch, hydration cover, beverage holder, multiple hatch-cover mounted accessories such as a marine compass, and select electronic gear such as a VHF radio or GPS unit, an aft hatch fitted with a waterproof storage bag, and a hydration compartment fitted with a hydration reservoir and draft tube, routed to the kayaker through a sealed hull port. Variants of this arrangement may be adapted to closed-hull kayaks, sit-on-top kayaks, canoes, catamaran, and similar personal watercraft. Optimum use is by open water boaters such as sea kayaks, touring kayaks, canoes, and catamaran, as opposed to white water kayaks.

This system is comprised of components that are easily accessed while the personal watercraft is underway.

The beverage holder component accommodates a broad array of common containers.

The depth of the holder provides a stable holder for these beverages.

The holder depth improves beverage temperature stability by reducing exposure

The hydration reservoir containment features provide four optional configurations that each allow under way use of industry standard reservoir integrated draft tubes Reservoir locations include two configurations within accessory hatches, and two independent locations within the hull. One accessed via the aft storage hatch, and the other aft of the seat, within the cockpit.

All hydration compartments are fabricated from durable vinyl mesh fabrics and are easily detachable for cleaning or other purposes.

Compartments are also easily compressed if space is needed for other purposes.

Compartments may also be used to provide separate storage of other items.

Hydration reservoirs are configured in secure, hygienic, unobtrusive locations on the watercraft.

System hydration reservoir configurations lower net center of gravity compared with paddler backpack units. Watercraft stability is enhanced.

Paddler fatigue is reduced by avoiding on-body backpack reservoir units.

Paddler safety is enhanced by avoidance of backpack reservoir units having potential for entanglement during recovery from watercraft rollovers.

The system accepts virtually all contemporary sports hydration reservoirs.

The hatch cover and hull ports provide sealed routing for the hydration reservoir draft tubes avoiding environment waters entering the hull.

System draft tube port seals provide dual function, sealing the port with or without the draft tube in active use position.

All port seal components are tethered.

System provides easily accessible secure location for various navigation-communications devices such as marine compasses, GPS, VHF, FRS, cell phones, and the like.

System accepts common accessory manufacturer and aftermarket mounting adapters for these devices.

System provides several alternate storage locations for these devices when not in use. All options are easily accessible while underway. These include in-hull threaded storage rings, and several waterproof storage bag configurations.

Waterproof storage bags provide protection from hull bilge water and the like. These are fabricated from sewn vinyl material having seam configurations well above average bilge water depths, or using welded vinyl seams, or water proof treated fabrics and the like. These are easily detached for cleaning.

System features tethered caps, covers, and accessory covers to avoid risk of loss overboard.

System hydration hatch cover features D-handled quick-thread covers allowing easy use with gloves and cold hands. The quick-thread allows rapid removal and replacement during adverse conditions. Non-visual manipulation of these covers is also enhanced due to the simple and convenient size of the handles.

System hatch adapters include pliable rubber-like adapters shaped to conform to watercraft foredeck variations as well as rigid adapters that allow use of existing hull day-hatch openings.

System installation facilitated through use of pre-molded platforms on watercraft hulls thereby simplifying or eliminating need for adapters.

Hatch adapters may be fabricated from injection molded plastic-type materials, or combinations of rigid and flexible materials. The flexible material options include urethanes, rubbers, and the like.

Provides a superior method of using one-handed pumping in closed-hull watercraft, using the most common portable manual pumps in the sport.

Emergency pumping may be done when the watercraft spray skirt is in place.

The in-hull holder for common portable pumps provides a secure, convenient, and unobtrusive storage alternative.

Pump holder features an auto-latch friction restraint securing pump in holder except when considerable direct withdrawal force is applied.

Fastening the various components to the hull may be accomplished using Velcro and similar materials, bolts, machine screws, sheet metal screws, clamps, adhesives, sealants, and the like.

Fasteners ideally are non-ferrous to avoid conflict with marine compass accessories. These may be brass, aluminum, plastic, nylon, and the like.

System component finishes are durable to resist salt water, extended sun exposure, broad ranges of temperatures, and minor impacts and abrasion.

System component durable finishes are integrated into the original manufacturing process or applied independently.

System components may be fabricated using elements of common industry products or custom manufactured as integral units. Finishes may be textured by mold enhancements, sand blasting, or use of textured paints and the like.

System materials are UV resistant.

The invention comprised of an integrated safety accessory arrangement and components for users of personal watercraft collectively provides integrated unique and superior features enhancing the personal safety of persons using these craft.

Although these descriptions contain specifics, these should not be construed as limiting the scope of the invention but considered as illustrations of some of the preferred embodiments of this invention system. For example, other materials may be used to fabricate the components such as the full array of moldable, injectable, fuseable, and bondable materials.

Thus, the scope of this invention system should be determined by the appended claims and their legal equivalents, rather than the specific examples given.

I claim:

1. An integrated safety accessory arrangement and components for users of personal watercraft whereby access is provided to accessories comprising a plurality of personal hydration accessories, navigation accessories, communication accessories, and manual pump accessories, wherein said accessories are accessible while said watercraft is underway thereby facilitating personal hydration, navigation, communications, and self-rescue emergency pumping by users of said watercraft, said arrangement and components comprising:

a personal watercraft having a hull, a user seat on said hull, a multi-purpose accessory hatch positioned forward of said seat, said hatch comprising a hatch fitting and hatch cover, wherein said hatch and said cover serve as an operating platform for said accessories, a containment sleeve for a flexible personal hydration reservoir with integral draft tube positioned internal to said hatch, said hatch cover fitted with a sealed hydration port having an aperture sized to pass said tube, a tether securing a cap to said port, a pump holder attachment to said hatch, said holder sized and configured for said accessory pump, whereby said pump may be stored or operated, dependant on selected position, an internal beverage holder for said hatch, a storage ring fitting situated proximate to said hatch on interior bottom of said hull, wherein said hatch cover(s) and said accessories mounted upon said hatch covers may be stored and easily accessed by said user while underway in said watercraft, a companion hip-hatch with internal storage bag and tethered hatch cover sized to allow internal storage of said accessory hatch covers and said covers fitted with said accessories, and said reservoirs, improved with addition of said hydration port to said hatch cover, said storage bag sized to store said reservoir and said mounted accessories, said port positioned in said hull proximate to said compartment and said seat, wherein said tube is accessible to said user while underway in said watercraft, whereby said arrangement and components are functionally effective in any combination individually and collectively.

2. An accessory arrangement and components as defined in claim 1, further including a flexible adapter positioned between said accessory hatch and said hull providing conformance with said hull and said hatch such as to seal said hull from exterior waters while positioning upper surface of said hatch in a nearly level plane desirable for select said accessories.

3. An accessory arrangement and components as defined in claim 1, further including a rigid adapter positioned between said accessory hatch and said hull providing conformance with said hull and said hatch such as to seal said hull from exterior waters while positioning upper surface of said hatch in a nearly level plane desirable for select said accessories.

4. The rigid adapter defined in claim 3 further comprising an internal storage bag secured to said adapter wherein said accessory hatch covers may be stored and made easily accessible by said user while underway in said watercraft, an aperture in said rigid adapter having a predetermined size whereby said hatch covers may pass into said bag, a hinge whereby said accessory hatch can be fastened to upper surface of said adapter and tilted open providing access to said bag, a flexible seal between said hatch and said adapter, a latch mechanism securing said hatch in closed position.

5. The latch mechanism defined in claim 4 further comprising a flexible fastener between said adapter and said hatch, fastened on one end, and latched to an anchor on the other whereby said latch can be unsecured or secured.

6. An accessory arrangement and components as defined in claim 1, wherein conforming said accessory hatch with said hull contours is achieved by molding said hull into a platform sized and tilted to provide a flat platform.

7. An accessory arrangement and components as defined in claim 1, wherein said manual pump holder is positioned on underside of said hull foredeck, said holder conforming to said pump and positioned whereby said pump will not conflict with said seated user, a friction surface is incorporated internal to said holder whereby said pump is not inadvertently dislodged.

8. An accessory arrangement and components as defined in claim 1, wherein said pump holder further includes opening(s) positioned to allow insertion of said pump through said accessory hatch and said holder extending toward bottom interior of said hull whereby operation of said pump can result in removal of water flooding interior of said hull.

9. The pump holder of claim 8, fitted with said pump in operating position, wherein a deck elastic placed in common configuration secures said pump while operationally positioned, wherein said elastic is tensioned by extension and secured over any non-moving protrusion of said pump thereby restraining said pump in an effective operating position enabling desirable one-handed pumping.

10. An accessory arrangement and component as defined in claim 1, further comprising a hull port, said port sized to fit draft tubes and alternatively sealed while said tubes are not in use, a removable cap with tether and seal.

11. The port cap defined in claim 10 wherein said cap is further refined with an aperture in said cap, a rotatable concentric disc internal and proximate and in parallel plane to top of said cap, an aperture in said disc sized to approximately match said draft tube diameter and said cap aperture wherein said apertures in alignment allow passage of said tube, said tube when positioned through said said aligned apertures wherein said cap may be affixed to said port achieving a sealed condition.

12. The disc in claim 11 wherein an appendage facilitates positioning of said disc aperture relative to said cap aperture thereby effecting alternate open and closed alignments of said apertures.

13. The port cap in claim 10 wherein said cap is tethered to said port using a flexible tether secured to said cap, said tether length predetermined wherein ample opportunity exists to allow manipulation of said tube, said tether being flexible, a compressible appendage at the terminus of said tether opposite the end fixed to said cap and of predetermined size allowing forced insertion through said port wherein anchorage is achieved by relaxed expansion of said appendage upon release of compressive force, resulting in an appendage size exceeding the port aperture.

14. An accessory arrangement and components as defined in claim 1, wherein said hatch cover is improved adding a tether anchorage attached to said cover on underside, said anchorage being compatible with a latching fastener fixed to said tether which is secured alternatively to said hatch, said hull, said pump holder, said companion hatch, said hatch cover.

15. An accessory arrangement and components as defined in claim 1, wherein said hatch covers are improved with a D-shaped bail style handle pivoted in the general plane of top of said hatch covers rotatable through approximately one half rotation, depressions in said hatch covers approximately matching said handle thereby allowing said handle to lay within said depressions in stored position.

16. An accessory arrangement and components as defined in claim 1,wherein said storage ring fitting(s) are fastened to said hull bottom, said storage ring fitting shaped on underside wherein an approximate match with contour of bottom of said hull is achieved, threads on said fitting compatible with those of said accessory hatch cover.

17. An accessory arrangement and components as defined in claim 1, wherein said compartment further comprising reinforcement of all openings, said compartment having a bottom sloped toward connection of said tube with said reservoir, whereby fluids in said reservoir placed in said compartment will totally drain to said outlet tube, a first means of fasting primary opening in said compartment wherein contents remain inside, a second means of fastening said compartment of aft interior of top of said hull.

18. Said fastening in claim 17 wherein Velcro in used as fastener.

19. An accessory arrangement and components as defined in claim 1, wherein said accessory hatch is further improved by addition of an internal beverage holder, said holder integrated into said hatch, said hatch further improved by addition of a detachable internal beverage holder.

* * * * *